United States Patent [19]

Oguri et al.

[11] Patent Number: 4,790,273

[45] Date of Patent: Dec. 13, 1988

[54] VERTICAL ENGINE FOR WALK BEHIND LAWN MOWER

[76] Inventors: Kiyohiko Oguri; Yoshiharu Isaka, both of c/o 2500 Shingai, Iwata-shi, Shizuoka-ken, Japan

[21] Appl. No.: 138,313

[22] Filed: Dec. 28, 1987

[30] Foreign Application Priority Data

Feb. 19, 1987 [JP] Japan ..... 62-36683
Feb. 19, 1987 [JP] Japan ..... 62-36684

[51] Int. Cl.[4] ..... F01M 1/00

[52] U.S. Cl. ..... 123/196 W; 123/195 HC; 123/41.42; 123/41.41

[58] Field of Search ..... 123/195 HC, 41.41, 196 W, 123/41.42

[56] References Cited

U.S. PATENT DOCUMENTS 4,570,584 2/1986 Uetsuji et al. ..... 123/195 HC
4,570,587 2/1986 Watanabe et al. ..... 123/195 HC

*Primary Examiner*—E. Rollins Cross
*Attorney, Agent, or Firm*—Ernest A. Beutler

[57] ABSTRACT

An improved lubricating system for an internal combustion engine having a horizontally disposed cylinder. The engine is provided with overhead valves that are disposed vertically above each other and which reciprocate about horizontally extending axes. The exhaust valve lies above the intake valve and the lubricating system delivers lubricant first to the exhaust valve and then by gravity to the intake valve. In addition, an arrangement is provided for submerging the valve operating tappets in lubricant to effect lubrication and silencing.

19 Claims, 4 Drawing Sheets

VERTICAL ENGINE FOR WALK BEHIND LAWN MOWER

BACKGROUND OF THE INVENTION

This invention relates to a vertical engine for a walk behind lawn mower and more particularly to an improved arrangement for lubricating an engine of the type having its cylinder disposed in a horizontally extending position.

Normally, internally combustion engines are operated in an orientation so that the cylinders are disposed generally vertically or at an angle to the vertical. In many applications, however, it is desirable, if not necessary, to operate the engine with the cylinders horizontally disposed. For example, in many types of engine powered implements, such as rotary lawn mowers, it is desirable to operate the engine so that the output shaft rotates about a vertically extending axis. This permits the engine output shaft to be directly coupled to the driven element, such as the rotary mower blade in a mower of this type. The positioning of the engine with its cylinders extending horizontally presents certain problems, however. For example, if the engine is lubricated by a splash type system, it may be difficult to insure that the components are adequately lubricated. In addition, this type of engine application normally employs air cooled engines. As a result, it is further desirable to ensure that adequate quantities of lubricant flow across certain components of the engine to provide cooling in addition to lubrication.

For example, if the engine is provided with a valve operating mechanism that includes overhead type valves, it is essential to ensure good lubrication of the valve train. However, the horizontal disposition of the push rods and rocker arms and valve stems makes it difficult to insure good lubrication, particularly when a splash type lubrication system is employed. In addition, it is desirable to insure that the exhaust valves are adequately cooled with such an arrangement.

It is, therefore, a principal object of this invention to provide an improved lubricating system for an engine having its valves disposed in a horizontally extending position.

It is a further object of this invention to provide an improved system for lubricating and cooling the horizontally disposed exhaust valve of an internal combustion engine.

It is still a further object of this invention to provide an improved system for lubricating and cooling the valves in an engine of the splash lubricated type wherein the valves are horizontally disposed.

In connection with certain components of the valve train of an internal combustion engine, as is well known, there are provided clearances for normal operation and to allow for differences in thermal expansion. That is, it is the normal practice to provide a clearance in the operating mechanism for the valve train. Because of this clearance, noise is generated and it is desirable to provide an arrangement for minimizing the transmission of these noises externally of the engine. One way that this can be done is to immerse the components having the clearance in lubricant. However, this is difficult to do with horizontally disposed engines.

It is, therefore, a still further object of this invention to provide an improved arrangement for immersing components of the valve train of an engine in lubricant when the valve train components are horizontally disposed.

It is another object of this invention to provide an arrangement for entrapping lubricant in the area of the valve operating mechanism of a horizontally disposed engine.

SUMMARY OF THE INVENTION

A first feature of this invention is adapted to be embodied in an engine having a poppet type exhaust valve and poppet type intake valve each adapted to reciprocate about horizontally disposed axes and having the tips of their stem portions operating in a common valve operating chamber. In accordance with this feature of the invention, the exhaust valve lies vertically above the intake valve and means are providing for delivering lubricant to a point above the exhaust valve for flow of lubricant first across the stem of the exhaust valve for cooling the exhaust valve and then by gravity to the stem of the intake valve.

Another feature of the invention is adapted to be embodied in a valve operating mechanism for a reciprocating machine having a camshaft, a tappet slidably supported by the machine for reciprocation along a horizontally disposed axis and engaged with the camshaft. A push rod is supported for reciprocation about a generally horizontally disposed axis and is engaged at one end with the tappet and at another end with a valve actuator. The push rod is reciprocal in an enlarged horizontally disposed chamber formed in the engine. Means deliver lubricant to the chamber and means extend across at least the lower portion of the chamber between the ends of the push rod for forming a dam to effect accumulation of lubricant in the chamber and around the tappet.

DETAILED DESCRIPTION OF THE PREFERRED EMBODIMENT OF THE INVENTION

Figure 1:
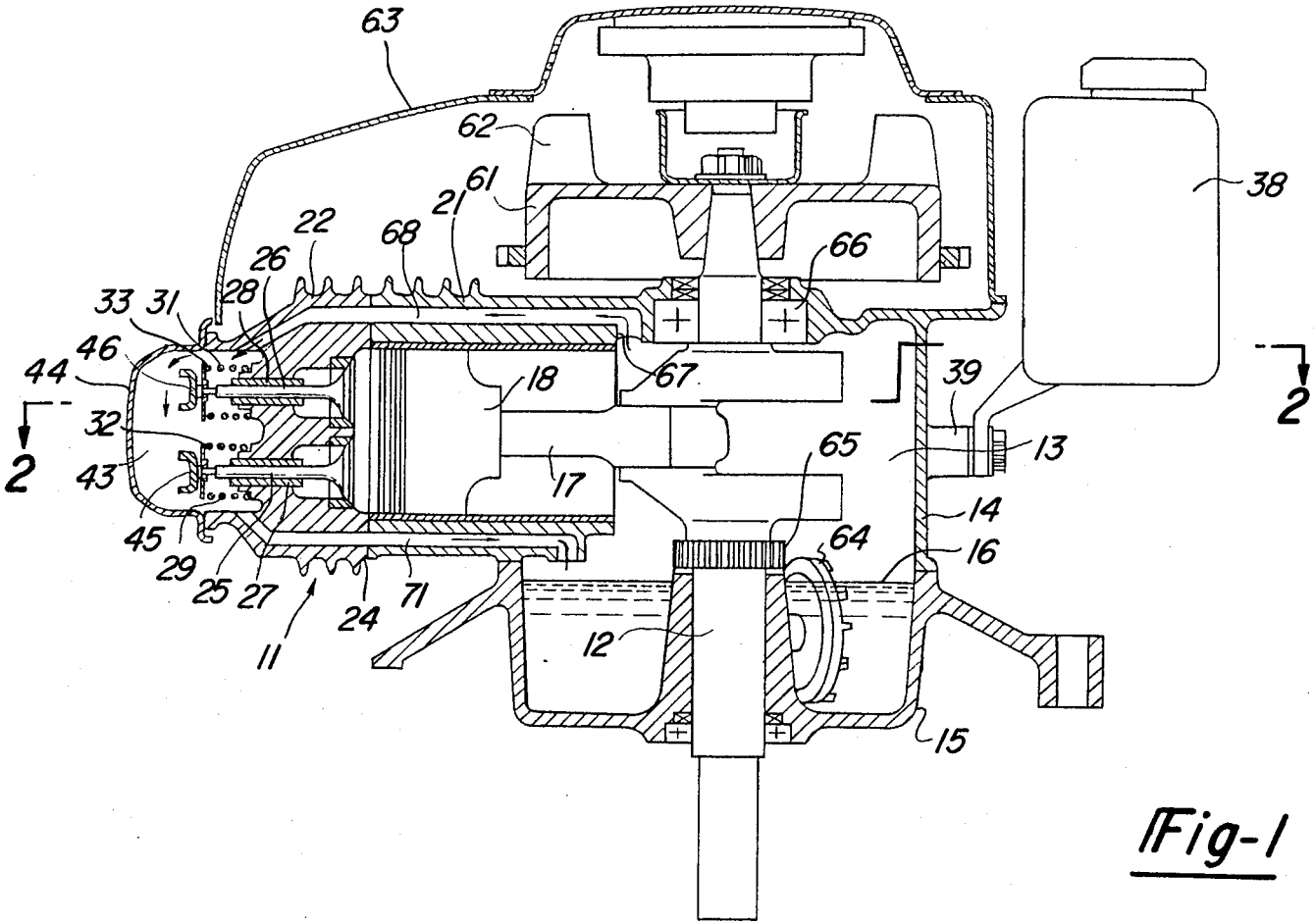
FIG. 1 is a cross-sectional view taken on a vertically extending plane through an internal combustion engine constructed in accordance with an embodiment of the invention.
Figure 2:
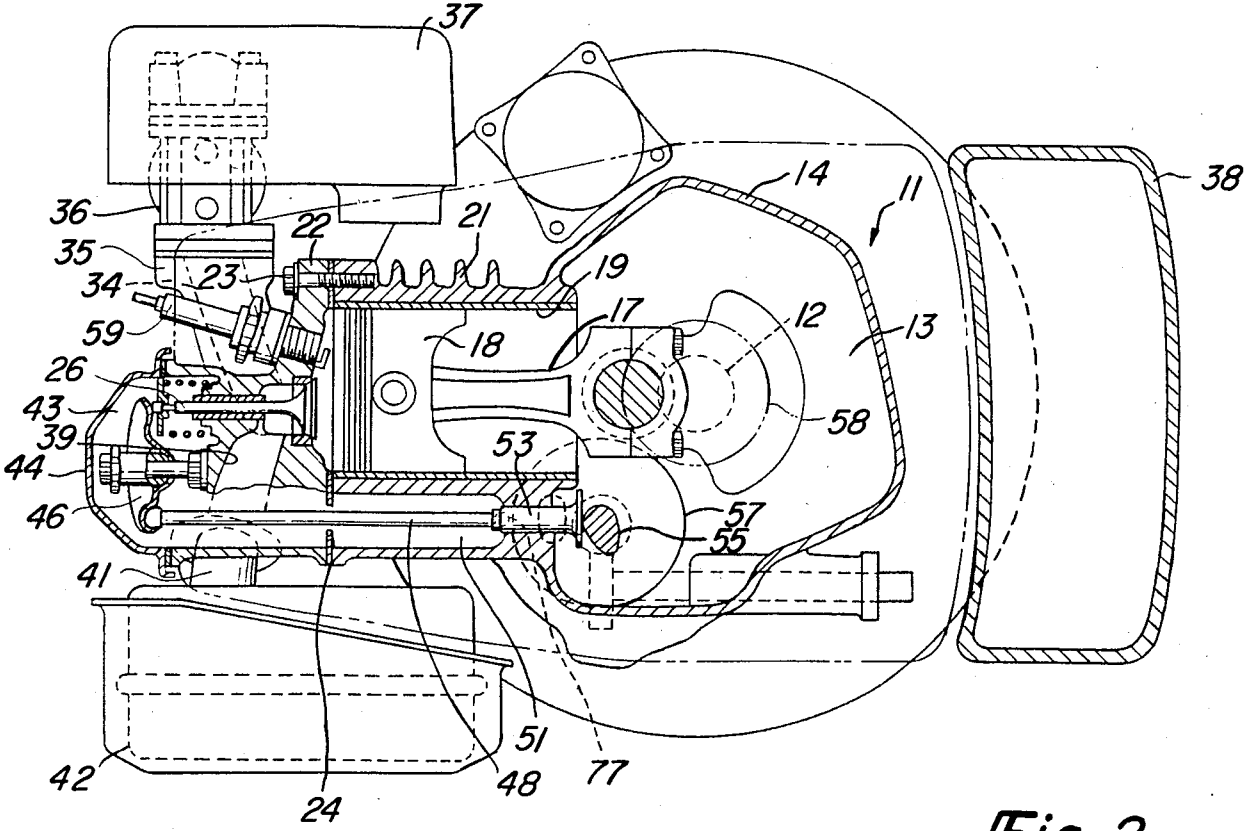
FIG. 2 is a cross-sectional view taken along the line 2—2 of FIG. 1.

In the drawings the reference numeral 11 indicates generally an internal combustion engine constructed in accordance with an embodiment of the invention. The engine 11 is adapted to operate an implement such as a lawn mower of the rotary type and for that purpose has its output shaft 12 supported for rotation about a generally vertically extending axis so that the output shaft 12 may be directly connected to a rotary blade (not shown) of the associated lawn mower.

The output shaft 12 in the illustrated embodiment comprises a crankshaft that rotatably journaled within a crankcase cavity 13 that is formed by a crankcase member 14 and a lower closure plate 15 which define an oil reservoir 16.

The crankshaft 12 is driven by means of a connecting rod 17 that is carried on a throw of the crankshaft 12 at its big end and which is pivotally connected at its small end to a piston 18 by a piston pin. The piston 18 is supported for reciprocation within a cylinder liner 19 that is affixed to a cylinder block 21. In the illustrated embodiment, the cylinder block 21 is formed integrally with the crankcase portion 14.

A cylinder head 22 is affixed to the cylinder block 21 by means of threaded fasteners 23. A gasket 24 is interposed between the cylinder head 22 and cylinder block 21 for sealing and other purposes, as will be described. The cylinder head 22 supports for reciprocation a poppet type intake valve 25 and poppet type exhaust valve 26. The axes of the stems of the valves 25 and 26 lie substantially in a common vertically extending plane. Valve guides 27 and 28 are pressed into the cylinder head 22 and slidably support the stems of the valves 25 and 26 in a known manner. Coil compression springs 29 and 31 encircle the stems of the intake and exhaust valves 25 and 26, respectively, and bear against keeper retainers 32 and 33 for urging the valves 25 and 26 to their closed positions.

An intake passage 34 is formed in the cylinder head 22 and extends from the intake valve 25 to a manifold section 35 to which a carburetor 36 is attached for delivering a fuel air charge to the combustion chamber of the engine. An air cleaner 37 is affixed to the carburetor 36 for filtering the intake air charge. Fuel is supplied to the carburetor 36 through a fuel supply conduit (not shown) from a fuel tank 38. The fuel tank 38 is supported on a lug 39 formed in the crankcase portion 14.

An exhaust passage 39 extends from the exhaust valve 26 through the cylinder head 25 toward the side opposite from the carburetor 36. The exhaust passage 39 communicates with an exhaust pipe 41 that delivers the exhaust gases to a muffler 42 for silencing and discharge to the atmosphere.

The tips of the stems of the intake and exhaust valves 25 and 26 extend into a valve chamber 43 formed at one end of the cylinder head 22 and which is enclosed by a rocker arm cover 44. The rocker arm cover 44 is affixed to the cylinder head 22 in an appropriate manner. Intake and exhaust rocker arms 45 and 46, respectively, are pivotally supported on posts that are affixed to the cylinder head 22 and are engaged at one end with the tips of the valves 25 and 26 for operating them.

Figure 3:
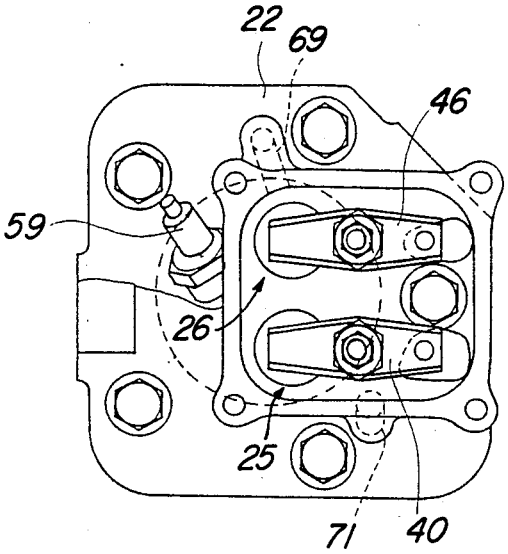
FIG. 3 is an end elevational view showing the cylinder head end of the engine with the rocker arm cover removed.
Figure 4:
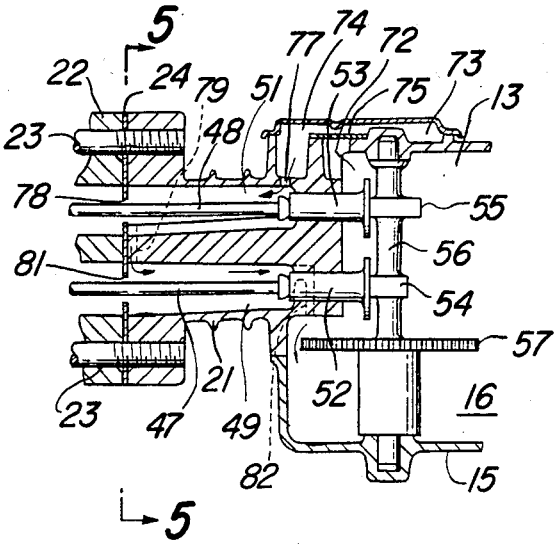
FIG. 4 is an enlarged cross-sectional view taken along the line 4—4 of FIG. 2.
Figure 5:
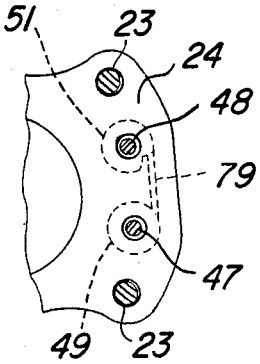
FIG. 5 is a cross-sectional view taken along the line 5—5 of FIG. 4.
Figure 6:
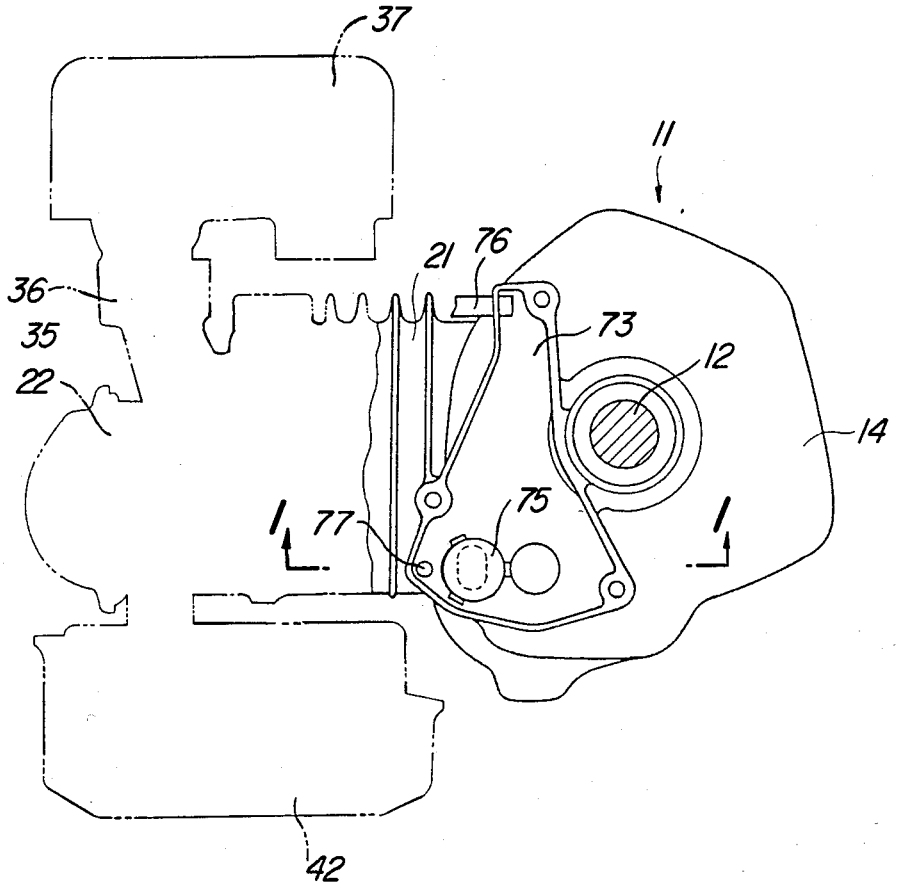
FIG. 6 is a top plan view of a portion of the engine with a cover plate removed and parts of the engine shown in phantom.

The other ends of the rocker arms 45 and 46 are engaged by one end of respective push rods 47 and 48 (FIGS. 3 and 4). The push rods 47 and 48 lie on one side of the cylinder liner 19 and pass through respective openings 49 and 51 formed in the cylinder block 21. At the lower ends of the openings 49 and 51, tappets 52 and 53 are slidably supported within the cylinder block 21. The lower ends of the tappets 52 and 53 are engaged with respective lobes 54 and 55 of a camshaft 56. The camshaft 56 is supported for rotation about an axis that is parallel to the axis of rotation of the crankshaft 12. Timing gears 57 and 58 are affixed to the camshaft 56 anbd crankshaft 12 respectively for driving the camshaft 56 at one half crankshaft speed, as is well known in this art.

A spark plug 59 is supported in the cylinder head 22 and has its spark gap positioned in the combustion chamber above the piston 18. The spark plug 59 is fired at an appropriate time so as to ensure that the charge in the combustion chamber will be adequately burned. The ignition system for firing the spark plug includes a flywheel magneto 61 that is affixed to the upper end of the crankshaft 12. The flywheel magneto 61 includes fan blades 62 that circulate air across the engine 11 for its cooling through a cooling shroud 63.

The engine is provided with a splash type lubricating system that includes an oil slinger 64 that is rotatable about an angularly disposed axis and which is driven by an integral gear which is in mesh with a gear 65 formed on the crankshaft 12. The lubricating system may be generally of the type disclosed in copending application Ser. No. 060,068 entitled Vertical Engine For Walk Behind Lawn Mower, filed June 9, 1987 in the name of Yoshiharu Isaka and assigned to the assignee of this application.

Basically, the oil slinger 64 is arranged so as to throw oil for lubrication from the crankcase chamber 16 to the various moving components of the engine contained within the crankcase. The slinger 64 cooperates with the crankshaft 12 so as to lubricate not only an upper crankshaft support bearing 66 but also to direct lubricant to a valve operating lubricant inlet opening 67 (FIG. 1) formed in the cylinder block 21 adjacent the lower periphery of the cylinder liner 19. The lubricant inlet opening 67 cooperates with a generally horizontally extending lubricant passage 68 that is formed in the cylinder block 21 and which communicates with a corresponding passage 69 formed in the cylinder head 22. The cylinder head passage 69 communicates with the valve operating chamber 43 and specifically at a point directly above the stem of the exhaust valve 26 and in proximity to its tip where it is engaged by the rocker arm 46. As a result, the exhaust valve, which is the hotter of the two valves, will receive the cool lubricant first and effect cooling and lubrication of the exhaust valve 26. From there lubricant will flow by gravity to the intake valve 25 to cool it and also the point of engagement of the stem of the intake valve 25 with its associated rocker arm 45. As a result, the hotter valve (exhaust valve 26) will be cooled before lubricant flows to the cooler intake valve 25. The lubricant which has flown across the intake and exhaust valves 25 and 26 and their respective rocker arms 45 and 46 can then return to the crankcase lubricant chamber 16 through a return passage 71 that is formed in the cylinder head 22 and cylinder block 21.

In addition to the lubrication system for the intake and exhaust valves 25 and 26 and their associated rocker arms 45 and 46, there is also provided a system for lubricating the tappets 52 and 53 and their engagement with the cam lobes 54 and 55 and push rods 47 and 48. In addition, this lubrication system immerses the ends of the push rods 47 and 48 that engage the tappets 52 and 53 in lubricant so as to silence the clearance that is normally provided in this area. This lubrication and silencing system may be best understood by reference to FIGS. 2 and 4 through 6.

The splash lubrication system provided for by the oil slinger 64 also throws lubricant toward the camshaft 56 and specifically the area adjacent the lobes 54 and 55 so as to lubricate their bearing surfaces with the tappets 52 and 53. In this area there is also provided a lubricant passageway 72 adjacent the upper end of the camshaft 53 adjacent its upper bearing support which extends into a breather chamber 73 formed in the upper surface of the cylinder block 21. This breather chamber 73 is normally closed by means of a cover plate 74 and the communication of the passageway 72 wiht the chamber 73 is controlled by a one way check valve 75 that permits flow from the passageway 72 to the chamber 73 but not flow in the opposite direction. The breather chamber 73 communicates with the induction system through a conduit 76 (FIG. 6) so as to provide emission control.

Lubricant will enter the breather chamber 73 through the check valve 75 and then flow by gravity through a passageway 77 that communicates with the push rod chamber 51 immediately above the engagement of the end of the push rod 48 with the tappet 53 so as to lubricate these bearing surfaces. In addition, the lubricant will flow along the push rod chamber 51 but will be trapped to a certain depth in this chamber because the gasket 24 has an opening 78 that encircles the push rod 48 but which is smaller in diameter than the push rod chamber 51 as may be best seen in FIG. 4. As a result, the gasket 24 acts as a dam and will cause lubricant to accumulate in the push rod chamber 55 to such a depth as to partially submerge the tappet 53 and provide silencing.

A restricted drain passageway 79 extends from the push rod chamber 51 downwardly to the push rod chamber 49. Again, in this area the gasket 24 is provided with a restricted opening 81 that acts as a dam so as to cause lubricant to accumulate in the push rod chamber 49. The lubricant will impinge upon the push rod 47 so as to lubricate it and the engagement with the tappet 52. Again, the lubricant trapped by the dam provided for by the gasket 24 will partially submerge the push rod end that engages the tappet 52 so as to provide silencing. Lubricant from this dammed area can return to the crankcase chamber 16 through a drain passageway 82. As a result, there will be effective lubrication of the push rods 47 and 48 and sound deadening.

It should be readily apparent from the foregoing description that a very effective arrangement is provided for ensuring the lubrication of an internal combustion engine that operates with its cylinder and valves in a horizontally disposed arrangement and wherein the lubricant acts in addition to provide cooling for the lubricated components and also silencing of the clearances in the valve train.

It is to be understood that the foregoing description is that of a preferred embodiment of the invention and that various changes and modifications may be made without departing from the spirit and scope of the invention, as defined by the appended claims.

We claim:

1. In an engine having a poppet type exhaust valve and a poppet type intake valve each adapted to reciprocate about horizontally disposed axes and having the tips of their stem portions operating in a common valve operating chamber, the improvement comprising said exhaust valve lying vertically above said intake valve, means for delivering lubricant to a point above said exhaust valve for flow of lubricant first across the stem of said exhaust valve for cooling said exhaust valve and then by gravity to the stem of said intake valve.

2. In an engine as set forth in claim 1, wherein the engine is provided with a horizontally disposed cylinder.

3. In an engine as set forth in claim 2, wherein the lubricant is supplied to the valve chamber from a crankcase of the engine.

4. In an engine as set forth in claim 3, further including a return passageway extending from the valve chamber to the crankcase.

5. In an engine as set forth in claim 3, wherein the lubricant is delivered to the valve chamber from the crankcase by a splash type system.

6. In an engine as set forth in claim 1, further including means in the valve chamber for actuating the intake and exhaust valves.

7. In an engine as set forth in claim 6, wherein the means for actuating the valves comprises rocker arms pivotally supported within the valve chamber.

8. In an engine as set forth in claim 7, wherein the means for actuating the valves further comprise horizontally extending push rods each cooperable with a respective one of the rocker arms.

9. In an engine as set forth in claim 8, further including means for providing lubrication for the push rods.

10. In a valve operating mechanism for a reciprocating machine having a camshaft, a tappet slidably supported by said machine for reciprocation about a horizontally disposed axis and engaged with said camshaft, a push rod supported for reciprocation about a generally horizontally disposed axis and engaged at one end with said tappet and at its other end with a valve actuator, said push rod being reciprocal in an enlarged, horizontally disposed chamber formed by said engine, means for delivering lubricant to said chamber, and means extending across at least the lower portion of said chamber between the ends of said push rod for forming a dam to effect accumulation of lubricant in said chamber and around said tappet.

11. In a valve operating mechanism as set forth in claim 10, further including means for draining lubricant from the chamber.

12. In a valve operating mechanism as set forth in claim 11, wherein lubricant is delivered to the chamber by a splash system.

13. In a valve operating mechanism as set forth in claim 12, wherein the splash system is provided at one side of the chamber.

14. In a valve operating mechanism as set forth in claim 10, wherein there are a pair of tappets each associated with a respective push rod contained within a respective chamber as defined in claim 10 and having a respective dam, said chambers containing said push rods being vertically disposed one above the other and means for delivering lubricant from the upper most chamber to the lower most chamber.

15. In a valve operating mechanism as set forth in claim 14, wherein the means defining the dam comprises a common member extending into each of the chambers.

16. In a valve operating mechanism as set forth in claim 15, further including means for draining lubricant from the chamber.

17. In a valve operating mechanism as set forth in claim 16, wherein lubricant is delivered to the chamber by a splash system.

18. In a valve operating mechanism as set forth in claim 17, wherein the splash system is provided at one side of the chamber.

19. In a valve operating mechanism as set forth in claim 15, wherein the common member comprises a cylinder head gasket.

* * * * *